United States Patent [19]

Sandi et al.

[11] Patent Number: 4,520,241

[45] Date of Patent: May 28, 1985

[54] MULTIPLE PUSH BUTTON SWITCH WITH LATCH MEMBERS

[75] Inventors: Floyd J. Sandi, Clawson; Anthony Vultaggio, Warren, both of Mich.

[73] Assignee: Essex Group, Inc., Fort Wayne, Ind.

[21] Appl. No.: 583,061

[22] Filed: Feb. 23, 1984

[51] Int. Cl.[3] ..... H01H 9/20

[52] U.S. Cl. ..... 200/5 B; 200/5 E; 200/50 C

[58] Field of Search ..... 200/5 R, 5 B, 5 C, 5 D, 200/5 E, 50 C, 320–322, 328

[56] References Cited

U.S. PATENT DOCUMENTS

| | | | |
|---|---|---|---|
| 2,458,807 | 1/1949 | Tucker | 337/69 |
| 2,469,650 | 5/1949 | Isserstedt | 200/5 |
| 2,790,858 | 4/1957 | Tseng et al. | 200/5 |
| 3,303,295 | 2/1967 | Davis | 200/5 B |
| 3,504,372 | 3/1970 | Sharples | 200/50 |
| 3,560,677 | 2/1971 | Kolb et al. | 200/5 B X |
| 3,706,866 | 12/1972 | Foley | 200/50 |
| 3,873,955 | 3/1975 | Bauer | 337/72 |
| 3,889,075 | 6/1975 | Morrell et al. | 200/5 E |
| 4,143,252 | 3/1979 | Moore | 200/5 |
| 4,213,017 | 7/1980 | Lewis | 200/5 |
| 4,323,744 | 4/1982 | Sheridan et al. | 200/153 |
| 4,392,029 | 7/1983 | Schaud et al. | 200/5 B |

*Primary Examiner*—J. R. Scott

*Attorney, Agent, or Firm*—Robert D. Sommer

[57] ABSTRACT

A multiple push-button switch having three push-button actuators for operation of two contact carrying leaf spring strips each normally urged to a rest position by its natural resilience but adapted for flexing to an actuated position. Each strip is associated with a respective latch member adapted to releasibly retain the strip in its actuated position. A first of the actuators engages the two strips when depressed to deflect the strips from their rest positions to actuated positions in latched engagement with the latch members. The second actuator when depressed interacts with one strip and the latch member associated with the other strip to deflect the one strip from its rest position to its actuated position in latched engagement with its associated latch member and to concurrently disengage the other latch member from the other strip for return thereof to its rest position from an actuated positon. The third actuator engages the two latch members when depressed to disengage the latch members from the respective strips for return of the latter to their rest positions from actuated positions.

6 Claims, 5 Drawing Figures

MULTIPLE PUSH BUTTON SWITCH WITH LATCH MEMBERS

BACKGROUND OF THE INVENTION

This invention relates to electric switches, and particularly to multiple push-button switches having three operating modes or conditions for controlling a plurality of circuits such as those of a motor vehicle lighting system.

Control switches for vehicle lighting systems have three typical operating conditions: one in which no contacts are closed, a second in which one set of contacts are closed to energize the vehicle parking light and tail light circuits, and a third position in which two sets of contacts are closed to energize the vehicle headlight circuit as well as the parking light and tail light circuits. One type of vehicle lighting control switch which has found wide use in the past employed a single longitudinally reciprocating actuator or operating member manually movable between three operating positions. Other vehicle lighting control switch constructions have been devised which include a pair of interacting operating members movable between two operating positions. This type of multiple switch has been disclosed, for example, in U.S. Pat. Nos. 3,504,372, 3,706,866, 4,213,017 and 4,323,744.

Since a vehicle lighting system typically has three operating modes, it would be desirable to employ a push-button switch having three selectively operable push-button actuators, one for each operating mode. Multiple push-button switches of this general type are known in the prior art and are disclosed, for example, in U.S. Pat. Nos. 2,790,858 and 4,143,252. The prior art switches of this type would be generally somewhat bulky, complicated and expensive when adapted for reliable operation of a motor vehicle lighting system and especially so when provided with means for illuminating the push-button actuators.

Another multiple push-button switch of substantially less cost and complexity is described in U.S. Pat. No. 2,469,650. The switch construction shown in this patent does, however, have some shortcomings. In particular, contact opening and closing takes place directly between the spring contact fingers and the locking bars and therefore would be unsuitable for switching the substantial load currents of vehicle lighting system. Accordingly, this switch would not be capable of reliable operation as a vehicle lighting control switch.

As shown by U.S. Pat. Nos. 2,458,807 and 3,873,955, there are other constructions of push-button switches known in the prior art that employ a latch member to releasibly latch a resilient contact contact carrying arm or strip in an actuated position to which it has been deflected by depression of a push-button actuator. The latch member is generally disengaged from the resilient arm or strip by a thermally responsive bimetallic element, although in some constructions of this type it may also be unlatched by returning the push-button actuator to its extended position. Such arrangements clearly are not suited for use in multiple push-button switches wherein various switch operating modes are selected by mere depression of the push-button actuators.

SUMMARY OF THE INVENTION

The present invention is an improved multiple push-button switch having three circuit controlling modes and which is relatively low in cost, compact in size and reliable in operation. The multiple push-button switch includes a housing, two contact carrying leaf springs each biased to a rest position, two latch members each spring biased to a normal latching position, and three push-button actuators each yieldably biased to an extended position in the housing. The strips are mounted cantilever fashion in the housing and extend generally parallel to each other in opposite directions. The latch members are adapted to releasibly retain respective ones of the strips in actuated positions but each is movable to an unlatching position for release of the respective strip and thereby permit return of that strip to its rest position. One of the actuators is effective when depressed to deflect the strips from their rest positions to actuated positions in latched engagement with the latch members. A second actuator is effective when depressed to deflect one strip from its rest position to an actuated position is latched engagement with one latch member and to concurrently move the other latch member out of latching engagement with the other strip for return of the latter to its rest position. The third actuator is effective when depressed to move the latch members out of latching engagement with the respective strips for return of the strips to their rest positions.

In the preferred embodiment of the invention, the two latch members are pivotally mounted in the housing adjacent respective free end of the strips and have parallel pivot axes generally perpendicular to the lengths of the strips. Each latch member includes a catch portion for latching engagement with the free end of a respective strip and further includes a cam portion extending laterally of the pivot axis. The first actuator includes two actuating portions projecting therefrom for respectively shifting the strips from their rest positions to actuated positions upon depression of the first actuator. An abutment portion of each catch portion is engaged by the free end of the respective strip to rotate the corresponding latch member from its latching position during movement of that strip from its rest position to its actuated position. The third actuator includes two release portions projecting therefrom engageable with the respective cam portions of the latch members for rotating the latch members from their latching positions to unlatching positions. The second actuator includes another actuating portion for shifting the one strip past the one latch member to its actuated position and also includes another release portion engageable with the cam portion of the other latch member for rotating that latch member from its latching position.

For a better understanding of the invention, reference may be had to the following detailed description taken in connection with the accompanying drawings, in which:

Figures 1, 1A:
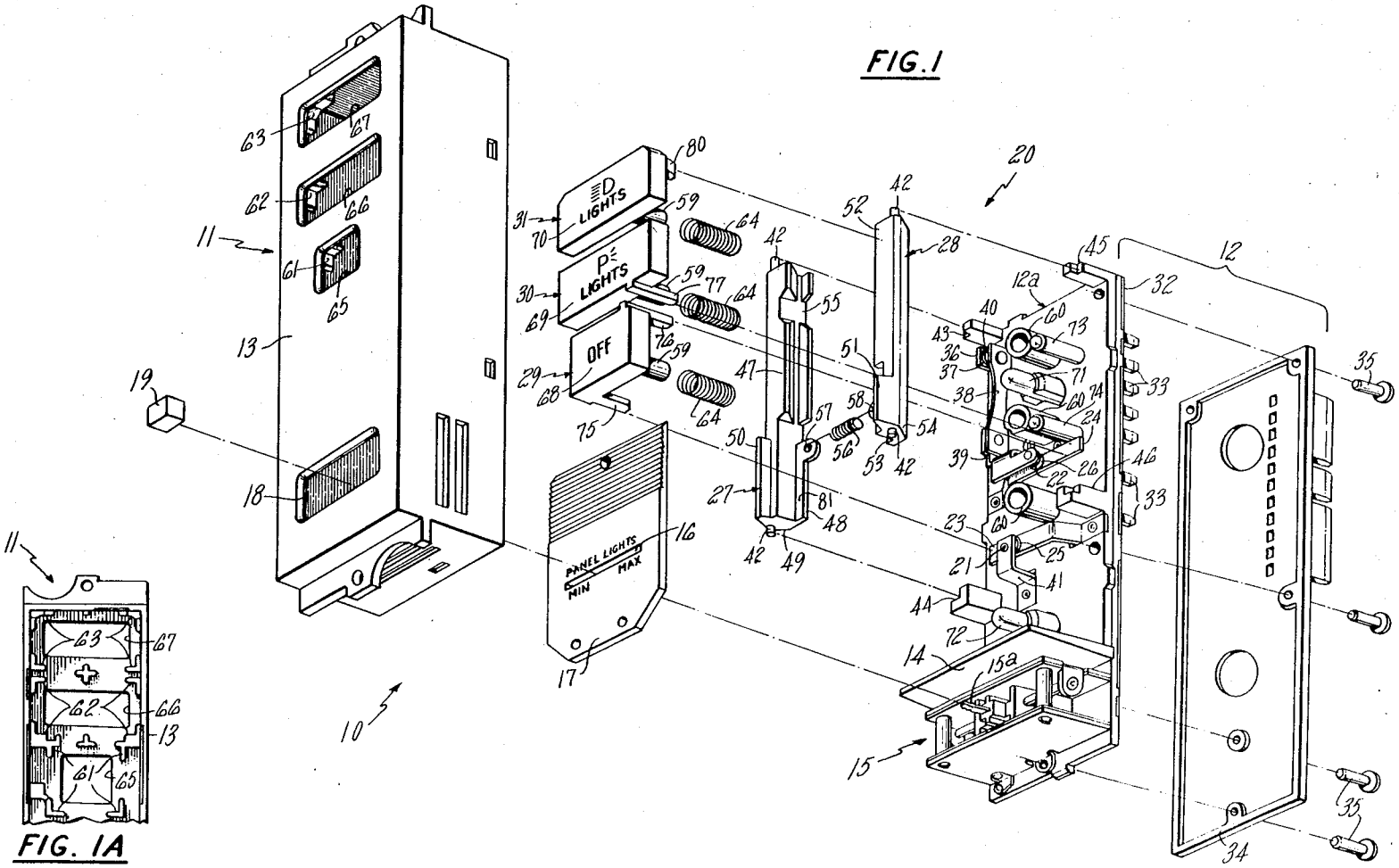
FIG. 1 is an exploded perspective view of a switch assembly including a multiple push-button switch constructed in accordance with the present invention.
Figure 2:
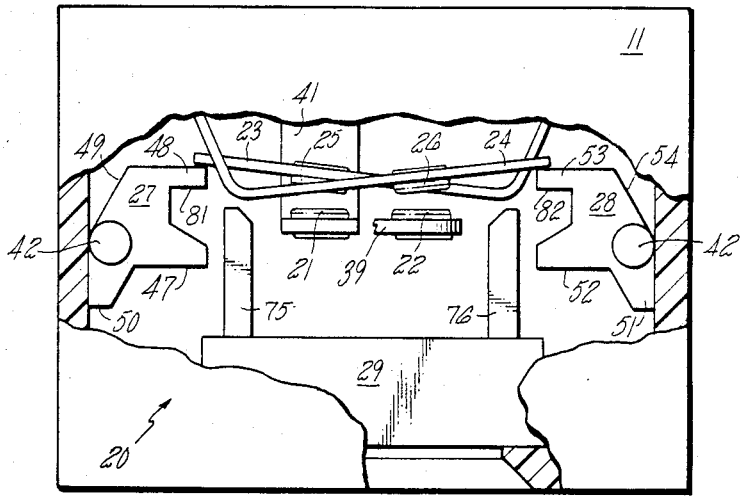
Figure 3:
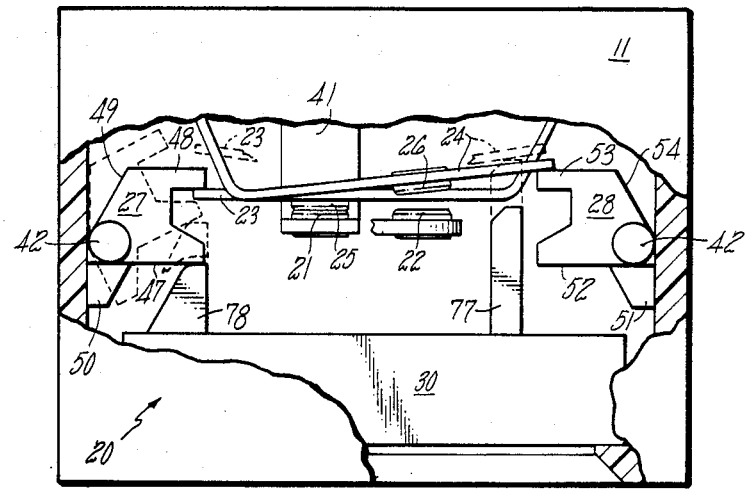
Figure 4:
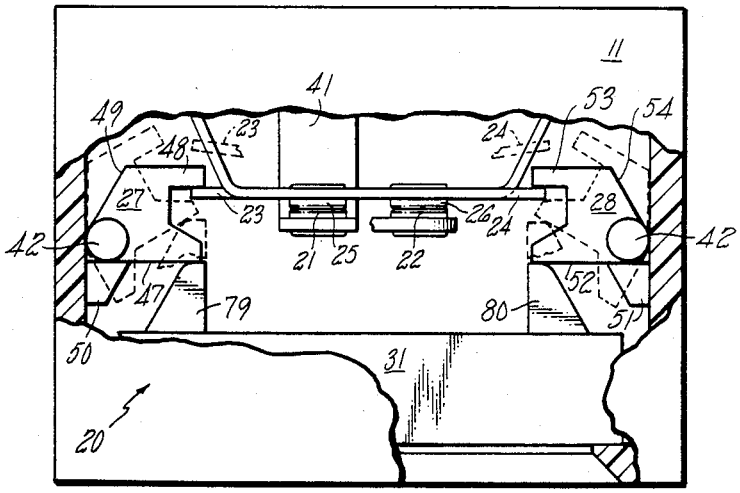

FIG. IA is a fragmentary interior plan view of the switch cover shown in FIG. 1;

FIG. 2 is a diagrammatic view illustrating one operating mode of the switch shown in FIG. 1;

FIG. 3 is a diagrammatic view illustrating a second operating mode of the switch shown in FIG. 1; and FIG. 4 is a diagrammatic view illustrating a third operating mode of the switch shown in FIG. 1.

DESCRIPTION OF THE PREFERRED EMBODIMENT

As representing a preferred embodiment of the present invention, there is illustrated a switch assembly 10 which may be employed to control a vehicle lighting system having a park lighting mode and a headlamp lighting mode. The switch assembly 10 includes a hollow housing 11 which has a base indicated generally at 12 that is suitably secured to a generally rectangular plastic cover 13. The housing 11 is divided internally into two compartments by a partition wall 14 integral with and extending perpendicularly to the base 12.

Mounted within one compartment of the housing 11 is a variable resistor and switch assembly 15 with slidable operating means 15*a* extending through the elongated slot 16 in a plastic lens plate 17 and an aperture 18 in the cover 13. The projecting end of the operating means 15*a* is provided with a knob 19 adapted to be controlled manually. The assembly 15 is a combination control for adjusting the level of energization of instrument panel lamps and for selectively energizing a vehicle interior dome lamp. The assembly 15 may be of any suitable or conventional construction and since it does not constitute a part of the present invention, it will not be described in detail.

Disposed in the other compartment of the housing 11 are various elements of a multiple push-button switch 20 which is constructed in accordance with the teachings of this invention. In addition to the housing 11, the switch 20 generally comprises two fixed contacts 21 and 22, two movable leaf spring strips 23 and 24 carrying respective movable contacts 25 and 26, two pivotally mounted latch members 27 and 28, and three manually operable push-button actuators 29, 30 and 31. The actuators 29, 30 and 31 are individually depressible from normal extended positions to retracted positions for selectively effecting movement of one or both movable contacts 25, 26 into or out of engagement with the fixed contacts 21, 22.

More specifically, the base 12 includes an insulative member 12*a* mounted back-to-back with a circuit board 32 which has conductive pathways (not shown) on its outer surface in a configuration to provide the necessary connections to the components of the switch assembly 10. The board 32 also carries seven terminals 33 of conventional construction connected to corresponding conductive pathways and adapted for connection to appropriate circuits of a vehicle lighting system. The board 32 and an insulative shroud 34 covering the pathways on the board are secured to the insulative member 12*a* by suitable means such as the rivets 35.

A bent bracket 36, formed of stamped metal, is secured at one end to the base 12 in an electrical connection with one of the pathways by a rivet, and the other end of the bracket 36 carries a fixed contact 37. A bimetal blade 38 welded at one end to one arm of another rigid metal bracket 39 carries a movable contact 40 adapted to normally engage the contact 37. The bimetal blade 38 is heated by current flow therethrough to separate contact 40 from contact 37 when a current overload occurs in the circuits connected to it. The bracket 39 is secured to the base 12 by a rivet and has another arm carrying the fixed contact 22 which faces the base 12 for cooperation with the movable contact 26 on the leaf spring strip 24. A further rigid metal bracket 41 is secured at one end to the base 12 in electrical connection with another of the pathways by a rivet and has an arm carrying the fixed contact 21 which faces the base 12 for cooperation with the movable contact 25 on the leaf spring strip 23.

The strips 23 and 24 are formed of a spring metal such as beryllium copper and are mounted cantilever fashion on the base 12 with their fixed ends secured to the base 12 in electrical connection with respective pathways on the circuit board 32 by rivets. The strips 23 and 24 are spaced apart and extend generally parallel to each other but in opposite directions from their respective fixed ends. Each of the strips 23 and 24 is bent adjacent its fixed end to provide a cantilever portion offset out of the plane of the fixed end. The strips 23 and 24 each have a natural bias tending to urge the strips to respective normal rest positions where the contact 25 is urged against the contact 21 and the contact 26 is urged against the contact 22. However, when either of the strips 23 and 24 is flexed toward the base 12 in a manner which will be described hereinafter, movable contact 25 or 26 is disengaged from the respective fixed contact 21 or 22. When the contacts 22 and 26 are closed, a circuit including the bimetal blade 38 and the contact 37 and 40 is completed between two of the terminals 33. When the contact 21 and 25 are closed, another circuit is completed between two other terminals 33. These circuits are respectively opened by the disengagement of the contacts 21 and 25 or 22 and 26.

The latch members 27 and 28 are in the form of elongated bodies each integrally molded from a suitable plastic material such as nylon 6/6 resin and terminated at its ends by trunnions 42. The notched ends of upright posts 43, 44, 45, 46 formed on the base 12 provide bearing support for the respective trunnions 42. In the assembled switch 20, the trunnions 42 are held in place by top and side wall sections of the cover 13. Accordingly, the latch members 27 and 28 are mounted adjacent respective free ends of the strips 23 and 24 for pivotal motion about parallel pivot axes which are generally perpendicular to the lengths of the strips.

The latch member 27 has a generally bifurcated side defining a cam portion 47 and a catch portion 48 which project outwardly toward the latch member 28. An opposite side of the latch member 27 has a sloped face 49 which is arranged to engage a side section of the cover 13 to limit rotation of the latch member 27 in one direction. Rotation of the latch member 27 in the opposite direction is limited by an upstanding stop arm 50 at one end of the latch member 27 that is adapted to also engage a side section of the cover 13. The similarly formed latch member 28 includes an upright stop arm 51, a cam portion 52 and a catch portion 53 projecting outwardly from one side, and an opposite side formed with a sloped face 54. The latch member 27 also may be notched as indicated at 55 to clear the bracket 36 during pivotal movement. As will be subsequently explained, the catch portions 48 and 53 each have one side adapted to hold the respective strips 23 and 24 in their actuated positions and an opposite side serving as an abutment engaged for turning movement of the latch member during motion of the strip toward its actuated position. A coiled tension spring 56 has its opposite ends hooked in apertures 57 and 58 formed in the respective catch portions 48 and 53 to normally bias the latch members in opposite directions to respective angular positions as determined by engagement of the stop arms 50 and 51 with side sections of the cover 13.

The push-button actuators 29, 30 and 31 are each molded of a suitable plastic material such as a polycarbonate resin which is preferably translucent. Each of the actuators 29, 30 and 31 is in the form of a generally rectangular cup and has inside the cup an axial post 59. The ends of these posts 59 fit into respective upstanding sleeves 60 on the base 12, which sleeves serves as guides for the posts. Three sets of integrally formed projections 61, 62 and 63 inside the cover 13 provide additional guiding means for the respective actuators 29, 30 and 31. A return spring 64 surrounding each post 59 is compressed between a respective actuator and the end of the associated sleeve 60 to yieldably bias the respective actuator to a normal extended position in engagement with the cover 13. The cover 13 has three generally rectangular apertures 65, 66 and 67 so that the respective actuators 29, 30 and 31 can be manually depressed to retracted positions for operating the switch 20.

Decals 68, 69 and 70 applied to the respective outer surfaces of the actuators may be provided with words and symbols as shown in FIG. 1 which indicate the functions of the switch 20. Light sources, such as the incandescent lamps 71 and 72 and the light emitting diodes 73 and 74, for illuminating the actuators are mounted on the base 12 and are suitably energized from pathways on the circuit board 32.

Two parallel actuating members or prongs 75 and 76 depend from diagonally opposite corners of the push-button actutator 29. These prongs 75 and 76 are adapted to engage the free ends of the respective strips 23 and 24 and flex the strips toward the base 12 upon depression of the actuator 29. A third actuating member or prong 77 depends from the actuator 30 and is similarly adapted to engage the free end of the strip 24 and flex that strip toward the base 12 upon depression of the actuator 30. Also depending from the actuator 30 is a release member or driver 78 adapted to engage the cam portion 47 of the latch member 27 and rotate that latch member from its normal position upon depression of the actuator 30. Two additional release members or drivers 79 and 80 depend from respective opposite sides of the actuator 31. These drivers 79 and 80 are adapted to engage the cam portions 47 and 52, respectively, of the latch members 27 and 28 and to rotate the latch members upon depression of the actuator 31.

Referring now to FIGS. 2–4, there are illustrated the three operating conditions of the switch 20 which are selectively effected by depression of the respective push-button actuators 29, 30 and 31. In FIG. 2, the strips 23 and 24 are flexed toward the base 12 and are releasibly retained in their actuated positions by engagement of their free ends with the catch portions 48 and 53, respectively, of the latch members 27 and 28. As the movable contacts 25 and 26 are disengaged from the respective fixed contact 21 and 22, the switch 20 is in its normally off condition.

When the push-button actuator 30 is now depressed to a retracted position, the release driver 78 on actuator 30 engages the cam portion 47 of the latch member 27 and rotates the latch member 27 to the dotted line position shown in FIG. 3. This movement of the latch member 27 disengages the catch portion 48 from the free end of the strip 23 with the result that the strip 23 is returned to its rest position by its natural resilience to cause engagement of the fixed contact 21 by the movable contact 25. At the same time, the actuating prong 77 on actuator 30 engages the strip 24 and flexes the strip 24 slightly beyond its actuated position as indicated by dotted lines in FIG. 3. When the actuator 30 is released, it is returned to its extended position by its associated return spring 64. This permits the latch member 27 to be returned to its normal latching position by the spring 56, but the leaf spring 24 merely returns to its normal actuated position in latched engagement with the catch portion 53 of the latch member 28.

If the push-button actuator 31 is depressed while the strips 23 and 24 are in the actuated positions shown in FIG. 2, the release drivers 79 and 80 on actuator 31 engage the cam portions 47 and 52, respectively, of the latch members 27 and 28. Further depression of the actuator 31 to its retracted position causes rotation of the latch members to the unlatching positions shown by dotted lines in FIG. 4 where the catch portions 48 and 53 are clear of the respective free ends of the strips 23 and 24. Upon disengagement of the strips 23 and 24 from the latch members, the strips are returned by their natural resilience to their respective rest positions with the movable contacts 25 and 26 in engagement with the fixed contacts 21 and 22, respectively. When the actuator 31 is released, it is returned to its extended position by associated return spring 64 allowing the latch members 27 and 28 to be returned to their normal latching positions by the spring 56.

Upon depression of the push-button actuator 29 while the strips 23 and 24 are in their rest positions shown in FIG. 4, the actuating prongs 75 and 76 engage the respective free ends of the strips 23 and 24 to force these strips against the upper sides or abutment portions 81 and 82, respectively of the catch portions 48 and 53. Further depression of the actuator 29 to its retracted position causes the strips 23 and 24 to be flexed to their respective actuated positions and then slightly further to the dotted line positions shown in FIG. 4. During these movements of the strips, the latch members 27 and 28 are rotated by the strips 23 and 24, respectively, until turned to such positions where the strips 23 and 24 clear the respective abutment portions 81 and 82. When the latch members 27 and 28 are thus disengaged from the strips, they are then returned to their normal latching positions by the spring 56. After the actuator 29 is released and returned to its extended position, the strips 23 and 24 engage the catch portions 48 and 53, respectively, of the latch members 27 and 28 in the latched condition shown in FIG. 2.

If the push-button actuator 29 is depressed while the strips 23 and 24 are in their respective rest and actuated positions shown in FIG. 3, the latch member 27 is momentarily rotated from its latching position during movement of the strip 23 to its actuated position by the actuating prong 75 on actuator 29 in the same manner described in the preceding paragraph. The latch member 28, however, is not rotated since the strip 24 is already in its actuated position. It will be apparent that the strips 23 and 24 are retained in their actuated position by the latch members upon return of the actuator 29 to its extended position.

When the push-button actuator 31 is depressed with the strips 23 and 24 in their respective rest and actuated positions shown in FIG. 3, the engagement of the cam portions 47 and 52 by the release drivers 78 and 79, respectively, causes rotation of the latch members 27 and 28 from their latching positions. The strip 24 is released from the catch portion 53 by rotation of the latch member 28 to its unlatching position for return of the strip 24 to its rest position. Rotation of the latch member 27 is of no effect since the strip 23 is already in its rest position.

Upon depression of the push-button actuator 30 while the strips 23 and 24 are in their rest positions as shown in FIG. 4, the latch member 28 is momentarily rotated from its latching position during movement of the strip 24 to its actuated position by actuating prong 77 in the manner previously described. The latch member 27 is rotated from its latching position by engagement of the release driver 78 with the cam portion 52 but this is of no effect since the strip 23 is already in its rest position.

It will now be observed that the present invention provides an improved latching arrangement for selectively latching either the strip 24 or both strips 23 and 24 in actuated positions and which is highly resistant to accidental release of the strips due to shock or vibration. It will also be observed that, upon depression of either of the actuators 30 and 31 in the off condition of the switch 20, there is a snap action release of the respective strip or strips from the associated latch members to provide a positive contact closing action. It will be further observed that the present invention provides a multiple push-button switch of the latching type which is of relatively simple and compact construction, economical to manufacture and reliable in operation.

Although the switch of the present invention has been shown and described with its contact closed in the rest positions of the strips 23 and 24, it will be understood that the fixed and movable contacts could be so arranged as to be closed in the actuated rather than rest positions of the strips. It will also be understood that although the switch of this invention has been described in conjunction with a vehicle lighting system, it will have uses in other types of systems.

While there has been described above the principles of this invention in connection with a specific switch construction, it is to be understood that this description is made only by way of example and not as a limitation to the scope of the invention.

What is claimed is:

1. A multiple push-button switch comprising:

a housing;

first and second fixed contacts in said housing;

first and second leaf spring strips extending generally parallel to each other in side-by-side relation and mounted cantilever fashion in said housing with the free ends of said strips extending in opposite directions from respective fixed ends thereof; said first and second strips each being urged to a rest position by its natural resilience but adapted for flexing movement to an actuated position;

a movable contact carried by each of said strips intermediate its ends for engaging a respective one of said fixed contacts in one of said rest and actuated positions;

first latching means adapted to releasibly retain said first strip in its actuated position;

second latching means adapted to releasibly retain said second strip in its actuated position;

spring means for biasing each of said latching means to a normal latching position from which position said latching means is movable to an unlatching position for release of the respective one of said strips;

a first push-button actuator yieldably biased to an extended position in said housing, said first actuator being movable toward said first and second strips and being effective when depressed to deflect said strips from their rest positions to actuated positions in latched engagement respectively with said first and second latching means;

a second push-button actuator yieldably biased to an extended position in said housing, said second actuator being movable toward said first strip and said second latching means and being effective when depressed to deflect said first strip from its rest position to an actuated position in latched engagement with said first latching means and to concurrently move said second latching means from the normal latching position thereof to disengage said second latching means from said second strip when the latter is in its actuated position and thereby permit said second strip to return to its rest position; and a third push-button actuator yieldably biased to an extended position in said housing, said third actuator being movable toward said first and second latching means from the normal latching positions thereof to disengage said first and second latching means respectively from said first and second strips when in the actuated positions thereof and thereby permit said strips to return to their rest positions.

2. A multiple push-button switch comprising:

a housing;

first and second fixed contacts in said housing;

first and second leaf spring strips extending generally parallel to each other in side-by-side relation and mounted cantilever fashion in said housing with the free ends of said strips extending in opposite directions from respective fixed ends thereof; said first and second strips each being urged to a rest position by its natural resilience but adapted for flexing movement to an actuated position;

a movable contact carried by each of said strips intermediate its ends for engaging a respective one of said fixed contacts in one of said rest and actuated positions;

first and second latch members pivotally mounted in said housing for engagement with respective free ends of said first and second strips for releasibly retaining said strips in their actuated positions;

spring means for biasing each of said latch members to a normal latching position from which position each said latch member is movable to an unlatching position for release of the respective one of said strips;

first, second and third push-button actuators each yieldably biased to an extended position in said housing and individually depressible to a retracted position;

first and second actuating means on said first actuator for respectively shifting said first and second strips from their rest positions to actuated positions in latched engagement respectively with said first and second latch members upon depression of said first actuator from an extended position to a retracted position;

third actuating means on said second actuator for shifting said first strip from its rest position to its actuated position in latched engagement with said first latch member upon depression of said second actuator from an extended position to a retracted position;

first release means on said second actuator for rotating said second latch member to disengage said second latch member from said second strip when the latter is in its actuated position and thereby release said second strip for return to its rest position upon depression of said second actuator; and second and third release means on said third actuator for rotating said first and second latch members to disengage said first and second latch member respectively from said first and second strips when the latter are in actuated positions thereof and thereby release said strips for return to their rest positions upon depression of said third actuator from an extended position to a retracted position.

3. A multiple push-button switch according to claim 2 wherein said first and second latch members include respective first and second catch portions engageable with respective free ends of said first and second strips to prevent movement of the respective strips from their actuated positions; said first latch member further including a first cam portion engageable by said second release means for rotating said first latch member from a latching position to an unlatching position upon depression of said third actuator and thereby disengage said first catch portion from said first strip in its actuated position so as to free said first strip for movement to its rest position; said second latch member further including a second cam portion engageable by said first and third release means for rotating said second latch member from a latching position to an unlatching position upon depression of either of said second and third actuators and thereby disengage said second catch portion from said second strip in its actuated position so as to free said second strip for movement to its rest position.

4. A multiple push-button switch according to claim 3 wherein said first and second catch portions include respective first and second abutment portions for latch member turning engagement with respective free ends of said first and second strips; the free end of said first strip engaging said first abutment portion during shifting of said first strip from its rest position to its actuated position by either of said first and third actuating means to momentarily rotate said first latch member from its latching position permitting the free end of said first strip to pass by said first catch portion and to be then engaged by said first catch portion when said first latch member is biased back to its latching position by said spring means; the free end of said second strip engaging said second abutment portion during shifting of said second strip from its rest position to its actuated position by said second actuating means to momentarily rotate said second latch member from its latching position permitting the free end of said second strip to pass by said second catch portion and to be then engaged by said second catch portion when said second latch member is biased back to its latching position by said spring means.

5. A multiple push-button switch according to claim 4 wherein said first and second latch members include respective first and second stop arms disposed for engagement with said housing in the respective latching positions of said first and second latch members; and said spring means include a coiled tension spring having its opposite ends attached to said first and second latch members at points offset from the points of pivotal support thereof to normally bias said first and second latch members in opposite directions to respective latching positions as determined by engagement of said stop arms with said housing.

6. A multiple push-button switch comprising:

a hollow housing comprising a base of insulating material and a cover;

first and second fixed contacts in said housing secured to said base;

first and second leaf spring strips within said housing each mounted on said base at its one end and each having a cantilever portion offset from its fixed end; said cantilever portions being arranged to flex relative to said fixed ends between respective rest and actuated positions; said first and second strips extending generally parallel to each other in side-by-side relation with said cantilever portions extending in opposite directions from respective fixed ends thereof;

said first and second strips carrying respective first and second movable contacts for respective engagement with said first and second fixed contacts; said first strip being urged by its natural resilience to a rest position where said first fixed contact is engaged by said first movable contact but is adapted for flexing movement away from that position to an actuated position; said second strip being urged by its natural resilience to a rest position where said second fixed contact is engaged by second movable contact but is adapted for flexing movement away from that position to an actuated position;

first and second latch members pivotally mounted in said housing adjacent respective free ends of said first and second strips; said latch members having parallel pivot axes generally perpendicular to the lengths of said strips; said first and second latch members having respective first and second cam portions extending laterally of the pivot axes thereof toward each other; said first and second latch members including respective first and second catch portions which are engageable with respective free ends of said first and second strips to prevent movement of the respective strips from their actuated positions to their rest positions and thereby releasibly retain said strips in their actuated positions; said first and second catch portions including respective first and second abutment portions for latch member turning engagement by respective free ends of said first and second strips during shifting of said strips from rest to actuated positions;

a coiled tension spring having its opposite ends attached to said first and second latch members at points offset from the points of pivotal support thereof to bias each of said first and second latch members to a normal latching position from which position said latch member is movable to an unlatching position;

first, second and third spring-biased push-button actuators mounted within said housing and each being individually depressible from a normal extended position to a retracted position;

said first actuator including first and second actuating portions projecting therefrom; said first and second actuating portions being effective upon depression of said first actuator to its retracted position to respectively shift said first and second strips from their rest positions to actuated positions in latched engagement with respective catch portions of said first and second latch members; said first and second latch members being momentarily rotated from their latching positions upon engagement of said first and second abutment portions by the respective free ends of said first and second strips during shifting thereof by said first actuator;

said second actuator including a third actuating portion and a first release portion projecting therefrom; said third actuating portion being effective upon depression of said second actuator to its retracted position to shift said first strip from its rest position to an actuated position in latched engagement with said first catch portion; said first latch member being momentarily rotated from its latching position upon engagement of said first abutment portion by the free end of said first strip during shifting thereof by said second actuator; said first release portion being effective upon depression of said second actuator to its retracted position to engage said second cam portion and rotate said second latch member from its latching position to its unlatching position and thereby disengage said second catch portion from said second strip in its latched position so as to free said second strip for movement to its rest position;

said third actuator including second and third release portions projecting therefrom; said second and third release portions being effective upon depression of said third actuator to its retracted position to respectively engage said first and second cam portions and to rotate said first and second latch members from their latching positions to unlatching positions and thereby respectively disengage said first and second catch portions from said first and second strips in the actuated positions thereof so as to free said first and second strips for movement to their rest positions.

* * * * *